US005390383A

United States Patent [19]

Carn

[11] Patent Number: 5,390,383

[45] Date of Patent: Feb. 21, 1995

[54] ANTERIOR PELVIC SUPPORT DEVICE FOR A SURGERY PATIENT

[75] Inventor: Ronald M. Carn, Redding, Calif.

[73] Assignee: SunMed, Inc., Redding, Calif.

[21] Appl. No.: 152,845

[22] Filed: Nov. 15, 1993

[51] Int. Cl.[6] ..... A61G 13/00

[52] U.S. Cl. ..... 5/624; 5/621; 128/877; 128/882

[58] Field of Search ..... 128/895, 846, 869, 877, 128/882; 5/621, 624, 630, 648

[56] References Cited

U.S. PATENT DOCUMENTS

| | | | |
|---|---|---|---|
| 2,735,738 | 2/1956 | Berne | 5/621 X |
| 3,844,550 | 10/1974 | McGuire | 5/621 |
| 4,526,355 | 7/1985 | Moore et al. | 5/624 |
| 4,583,725 | 4/1986 | Arnold | 5/621 |
| 4,766,892 | 8/1988 | Kreitman | 5/624 X |
| 4,913,413 | 4/1990 | Raab | 5/624 |

*Primary Examiner*—Michael F. Trettel
*Attorney, Agent, or Firm*—Kelly Bauersfeld & Lowry

[57] ABSTRACT

An improved anterior pelvic support device is provided for use in securely and safely positioning a patient during a surgical procedure, such as hip or pelvis surgery. The support device comprises a double-ended bracket arm having a pair of padded support members at opposite ends thereof and adjustably carried on a bracket post adapted for secure mounting as by clamping onto an operating table. The bracket arm is adjustably positioned to support the patient lying on one side in a lateral decubitis position, with the padded support members applied to bony prominences particularly such as the symphysis pubis and the lower side anterior superior iliac spine. The support device is used in combination with a posterior pelvic support plate, and a pair of anterior-posterior chest support plates to retain the patient in a secure and stable manner during surgery.

20 Claims, 4 Drawing Sheets

ANTERIOR PELVIC SUPPORT DEVICE FOR A SURGERY PATIENT

BACKGROUND OF THE INVENTION

This invention relates generally to improvements in surgical support devices for positioning and retaining a patient during a surgical procedure. More specifically, this invention relates to an improved surgical support device for securely and safely supporting a surgical patient in a position lying on one side. The invention is particularly designed to support and retain a patient during hip or pelvis surgery.

A variety of patient support devices are generally known in the art for use in supporting a surgery patient under general anesthesia on an operating table in a predetermined and substantially fixed position in order to facilitate certain surgical procedures. In this regard, such patient support devices are especially useful to support a surgery patient in a position lying on one side, commonly referred to as a lateral decubitis position, to facilitate surgical procedures such as hip and/or pelvic surgery. The support devices are typically mounted by clamps or the like onto side edges of the operating table, and provide upstanding support plates for engaging the patient anteriorly and posteriorly in the pelvic region and the chest region. Secure patient retention can be extremely important in the course of some surgical procedures such as hip arthroplasty wherein it is desirable to retain the patient in a fixed reference position relative to the operating table in order to achieve optimum fit and function of a hip prosthesis. Unfortunately, conventional patient support devices in the form of paddle-shaped and generally rectangular upstanding plates tend to engage soft tissues in the anterior pelvic region, resulting frequently in inadequate patient support and retention. Moreover, attempts to support the patient by contacting soft tissue, especially in the anterior pelvic region, have sometimes resulted in circulatory restrictions and/or other complications attributable to the pressure applied to vital organs.

There exists, therefore, a significant need for improvements in patient support devices for securely and safely engaging the anterior pelvic region of a surgery patient lying in a lateral decubitis position. The present invention fulfills this need and provides other related advantages.

SUMMARY OF THE INVENTION

In accordance with the invention, an improved anterior pelvic support device is provided for positioning and retaining a surgery patient in a predetermined reference position lying on one side on an operating table, thereby facilitating surgical procedures such as hip surgery, pelvic surgery, etc. The anterior pelvic support device is used in combination with other conventional support devices applied to the patient's posterior pelvic region, and to the chest region at the anterior and posterior sides thereof. The anterior pelvic support device of the present invention is adjustably mounted with respect to an operating table and includes a pair of spaced-apart padded support members for engaging the patient at a pair of spaced-apart points, particularly such as the bony prominences defined by symphysis pubis and anterior superior iliac spine.

In accordance with a preferred form of the invention, the support device comprises a double-ended bracket arm having a central portion joined to a pair of opposite ends disposed generally coplanar to each other and offset from the plane of said central portion. Padded elements are removably carried on the opposite ends of the bracket arm, whereby the bracket arm defines the pair of spaced-apart padded support members. The central portion of the bracket arm is adapted for adjustable connection to a bracket post in a manner permitting selection of the vertical position of the bracket arm in addition to rotational position of the bracket arm relative to the bracket post. Stop pins may be provided on the central portion of the bracket arm to engage the bracket post in a manner preventing rotational adjustment of the bracket arm, wherein these stop pins are adapted to engage the bracket post in one of two orientations corresponding respectively with a patient lying on his or her left side or right side. The bracket post is mounted in turn as by clamping to an L-shaped angle bracket which is secured as by clamping to a side rail extending along the side edge of the operating table. The clamp-on mounting of the bracket post permits anterior-posterior adjustment of the bracket arm relative to the operating table.

In a preferred system arrangement, the improved anterior pelvic support device of the present invention is used in combination with conventional patient support plates for securely and safely retaining the patient during surgery. A posterior pelvic support plate engages the relatively bony posterior pelvic region. A pair of anterior and posterior chest support plates engage the patient in the region of the sternum and near the base of the scapula, respectively.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
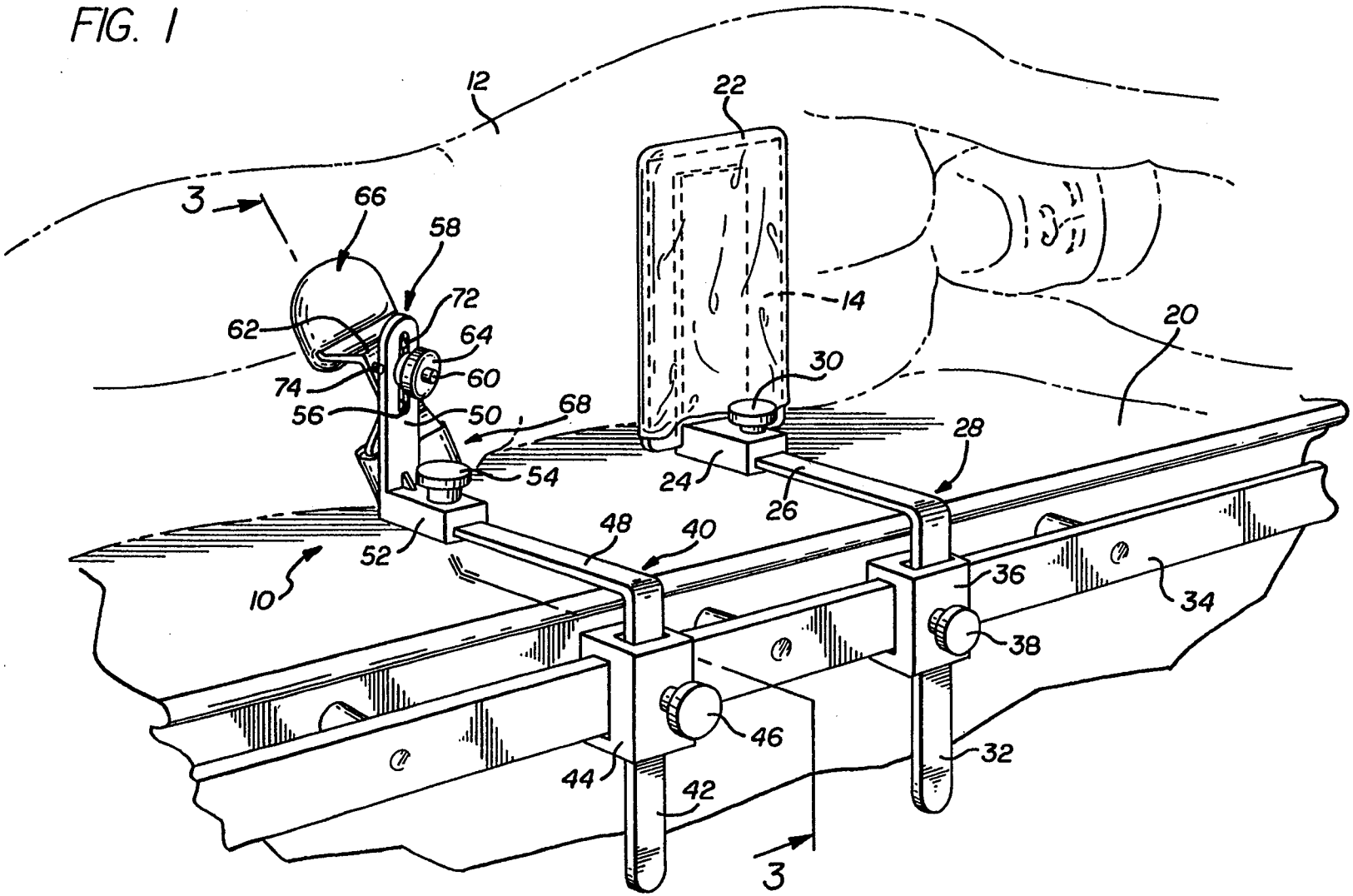
FIG. 1 is a fragmented perspective view illustrating an anterior pelvic support device embodying the novel/features of the invention.

As shown in the exemplary drawings, an improved support device referred to generally by the reference numeral 10 is provided for engaging and supporting the anterior pelvic region of a surgery patient 12. The anterior pelvic support device 10 is designed for use in combination with other conventional upstanding support plates 14, 16 and 18 (FIGS. 1 and 2) for retaining the patient in a position lying on one side, thereby facilitating certain surgical procedures such as hip surgery and/or pelvic surgery.

The improved support device 10 of the present invention recognizes that complications sometimes arise as a result of improper and/or inadequate patient positioning and retention during a surgical procedure. Such complications are particularly likely when significant force or pressure is required to retain the patient in a pretermined orientation while under general anesthetic, such as an inherently unstable position lying on one side, often referred to as the lateral decubitis position. In the past, conventional support devices in the form of flat upstanding support plates have been used to support the patient by engaging soft tissues in the anterior pelvic region, resulting in potential circulatory restriction and/or other complications arising as a result of pressure applied to internal organs. In addition, especially in hip arthroplasty wherein it is desired to retain the patient in a substantially fixed reference position relative to an operating table 20, anterior pelvic support by engagement of soft tissues has not provided adequate patient retention to ensure optimum fit and function of an implanted prosthesis.

Figure 2:
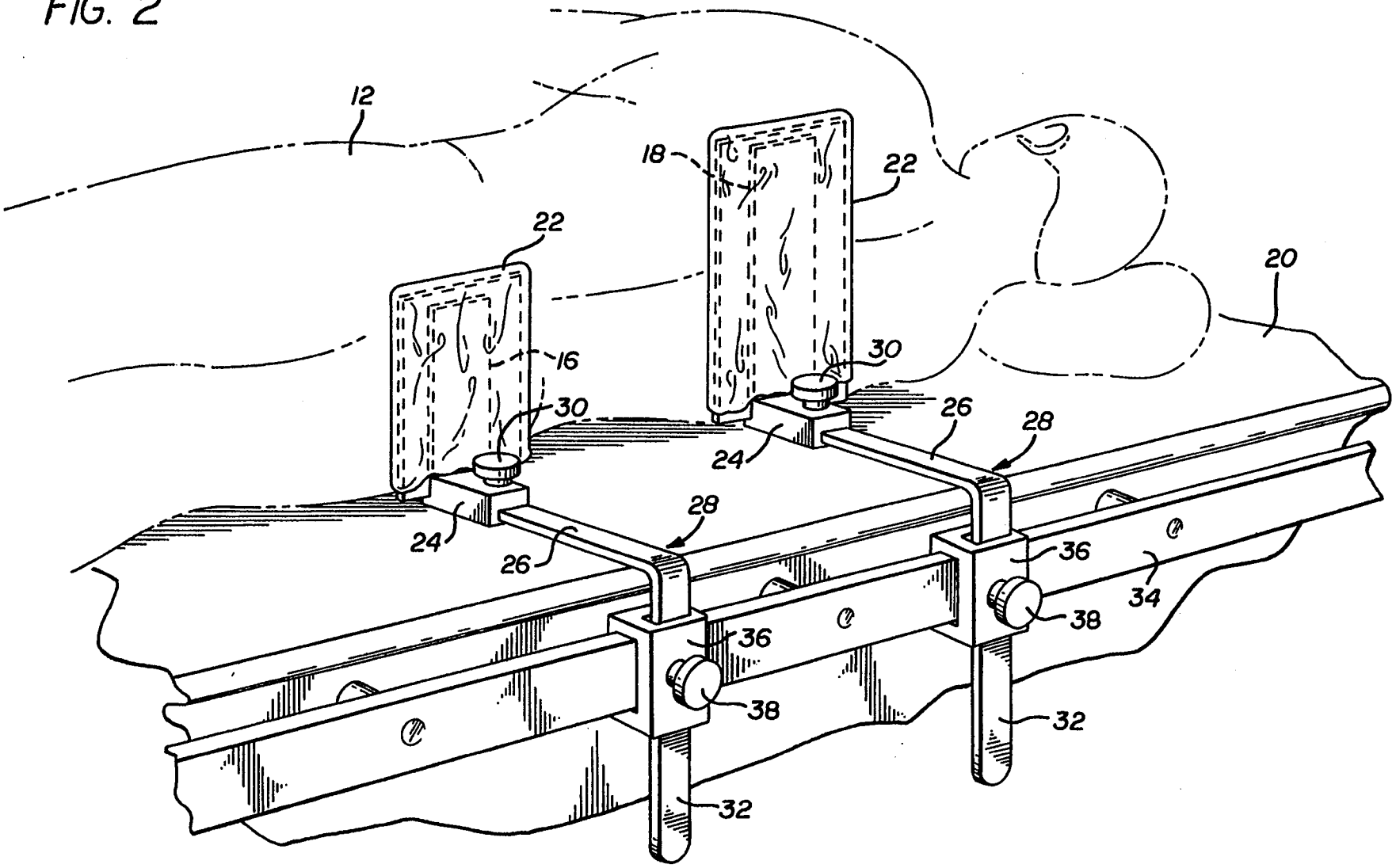
FIG. 2 is a fragmented perspective view illustrating posterior support devices for supporting a surgery patient.

As shown in generally in FIGS. 1 and 2, the improved support device 10 of the present invention is used to support the anterior pelvic region of the patient 12, in combination with the generally conventional flat support plates 12, 14 and 16 for engaging the patient at multiple locations other than the anterior pelvic region. More specifically, the flat and generally paddle-shaped support plates 14, 16 and 18 are each normally covered by a soft foam or fabric padding 22 and mounted in an upstanding position adjacent the patient 12 by a clamp base 24 adapted for slide-fit mounting onto the horizontal leg 26 of an L-shaped angle bracket 28. A clamp screw 30 releasibly secures the clamp base 24 to the angle bracket 28 at an adjustably selected position spaced inwardly from the adjacent side edge of the operating table 22. The horizontal leg 26 of each angle bracket 28 extends laterally to the side edge of the table, whereat a vertical leg 32 of the angle bracket 28 extends downwardly past a side rail 34. A side clamp 36 includes a clamp screw 38 for securely attaching the vertical leg 32 to the table side rail 34. As shown in FIGS. 1 and 2, the support plate 14 comprises an anterior chest support for engaging the patient 12 generally in the bony region of the sternum. The support plates 16 and 18 respectively comprise posterior pelvic and chest supports engaging the patient in the bony regions defined by the bony posterior pelvic region and by the scapula. The combination of patient support devices are thus provided in anterior-posterior pairs for engaging and supporting the patient on opposite sides. The position of each support plate 14, 16 and 18 is, of course, adjustably set in conformance with the anatomical geometry of each specific patient.

The anterior pelvic support device 10 of the present invention additionally uses an L-shaped angle bracket 40 which is adjustably secured to the table side rail 34 on the anterior side of the patient. More particularly, the angle bracket 40 includes a vertical leg 42 carrying a side clamp 44 having a clamp screw 46 for adjustable mounting of the angle bracket 40 to the operating table. An upper horizontal leg 48 of the angle bracket 40 extends laterally inwardly from the side edge of the table 20 to a position adjacent to the anterior pelvic region of the patient.

An upstanding bracket post 50 includes a slide clamp 52 at a lower end thereof for slide-on releasible attachment to the horizontal leg 48 of the angle bracket 40 by means of a clamp screw 54. The bracket post 50 defines a vertically elongated slot 56. A double-ended bracket arm 58 carries a mounting bolt 60 to project rearwardly from a central portion 62 of the bracket arm, for slide-fit reception through the slot 56 in the bracket post 50. A thumbscrew nut 64 is threaded onto the mounting bolt 60 at an outboard side of the bracket post 50, and may be releasibly tightened to secure the bracket arm 58 at a selected vertical position along the post slot 56.

Figure 3:
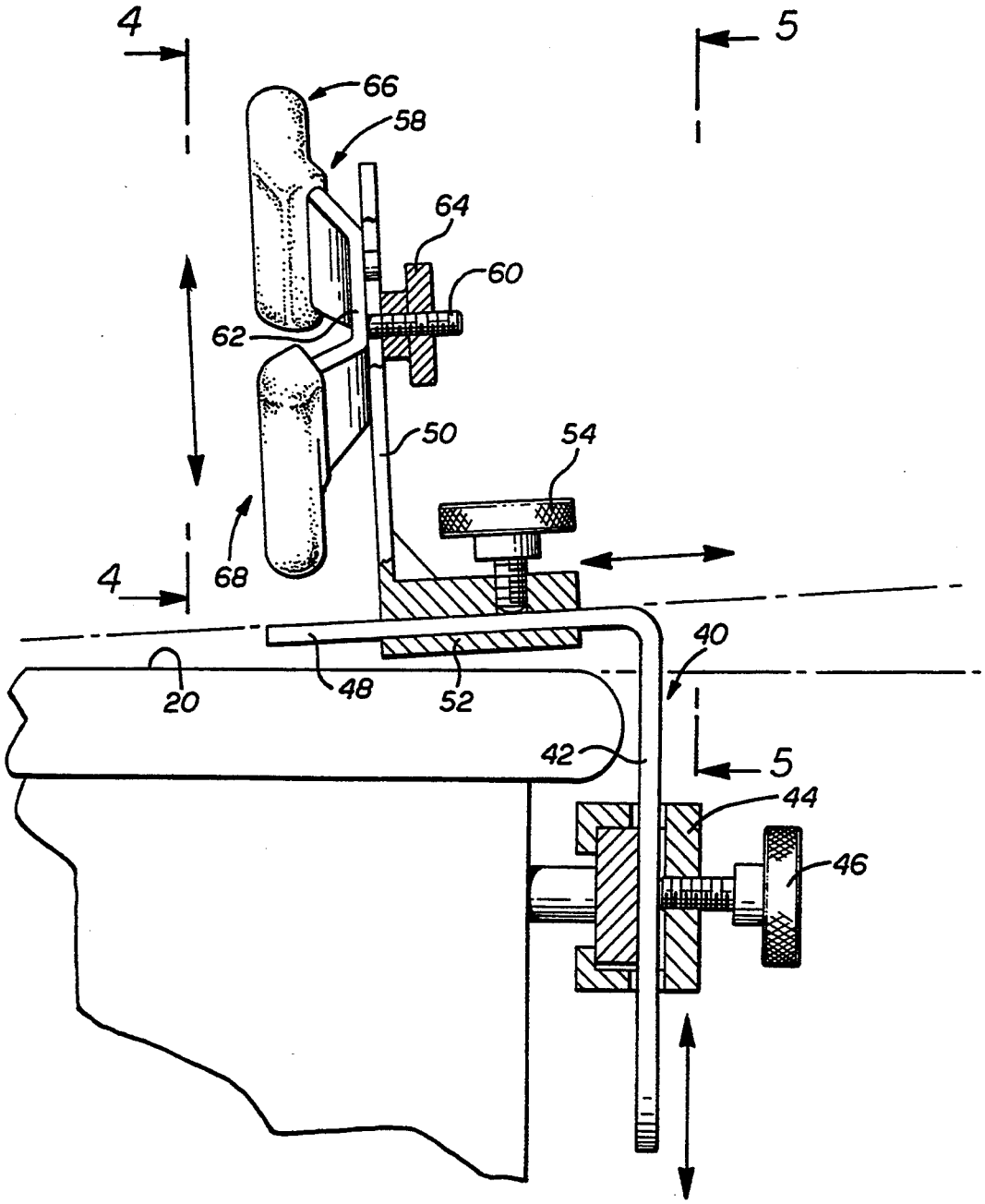
FIG. 3 is an enlarged fragmented vertical sectional view taken generally on the line 3—3 of FIG. 1.

The central portion 62 of the bracket arm 58 is offset ( FIG. 3 ) in an outward or outboard direction from opposite ends 66 and 68 which define a spaced-apart pair of substantially coplanar support members for the device 10. Padded material 70 of closed cell foam or the like is slip-fitted over the ends 66, 68 of the bracket arm. The specific positions of these padded support members are adjustably selected by appropriate loosening of the thumbscrew nut 64 to accommodate vertical displacement of the bracket arm 58 relative to the bracket post 50, and rotational orientation of the bracket arm 58 relative to a central axis defined by the axis of the mounting bolt 60. When the desired position of vertical and rotational adjustment is obtained, the thumbscrew nut 64 is tightened to securely retain the bracket arm 58 in a fixed position relative to the operating table.

Figure 4:
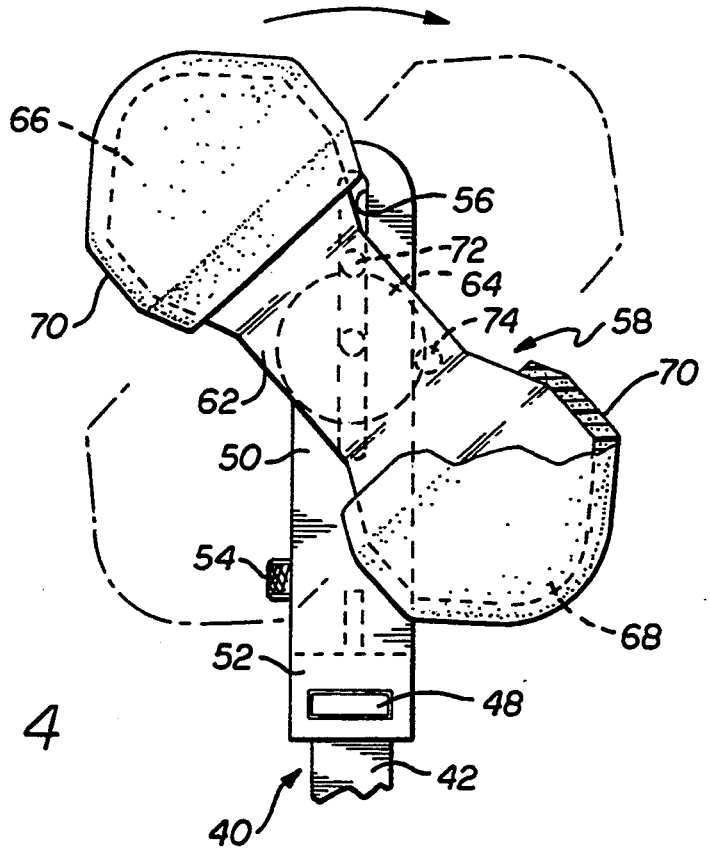
FIG. 4 is a front side elevational view of the anterior pelvic support device, taken generally on the line 4—4 of FIG. 3.
Figure 5:
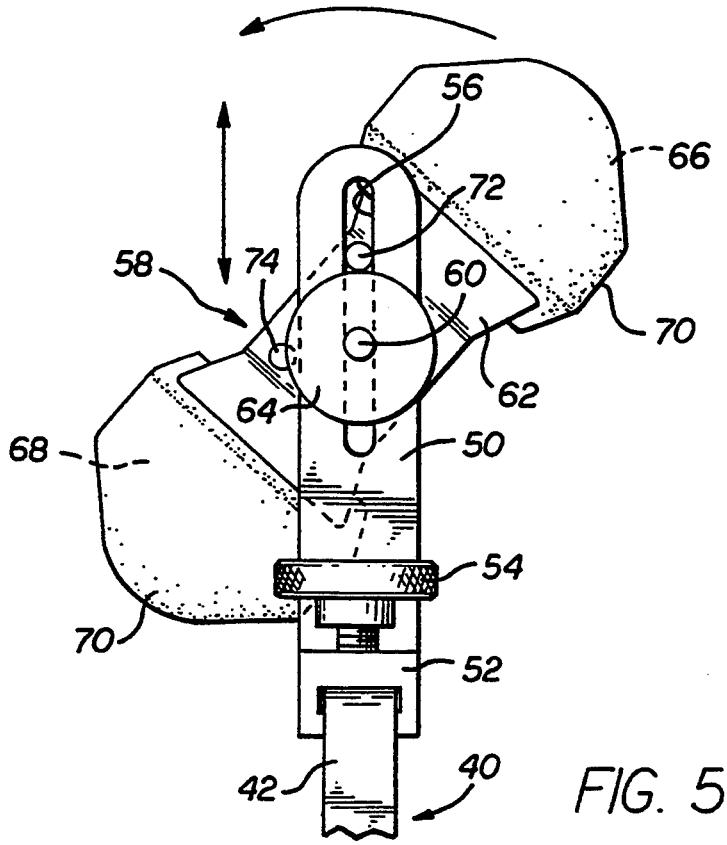
FIG. 5 is a rear side elevational view of the device, taken generally on the line 5—5 of FIG. 3.

In accordance with the preferred orientation of the support device 10, the padded support members 66 and 68 are oriented to contact bony prominences at the anterior pelvic region of the patient 12. Specifically, the bracket arm 58 is normally oriented angularly with respect to the bracket post 50, as viewed in FIGS. 4 and 5. The upper support member 66 is carefully positioned for engaging the symphysis pubis of the patient. Appropriate angular orientation of the bracket arm also positions the lower support member 68 to engage the anterior superior iliac spine at the lower side of the patient. The two support members 66, 68 thus engage the patient at spaced-apart bony prominences, whereby direct application of significant retention pressure to soft tissues and resultant associated complications are avoided. Moreover, the patient is securely retained in a substantially fixed position of reference with respect to the operating table. As shown in FIGS. 4 and 5, in a typical orientation of the bracket arm 58, the bracket arm is oriented at an angle of about 50 degrees relative to the upstanding bracket post 50.

To ensure fixed orientation of the bracket arm at this typical anatomical orientation, a pair of stop pins 72 and 74 may be threadably mounted onto the central portion 62 of the bracket arm 58, at appropriate positions respectively to ride within the vertical slot 56 and to engage one side edge of the bracket post 50, as shown in FIG. 5. This orientation of the stop pins 72, 74 relative to the bracket post properly positions the bracket arm with respect to a patient lying on his or her left side, as shown in FIG. 1. However, the orientation of the stop pins 72, 74 can be reversed, with the pin 74 seated in the slot 56 (not shown), for positioning the bracket arm relative to a patient lying on his or her right side. Alternatively, one or both of these stop pins 72 and 74 may be omitted to accommodate partial or unrestricted rotational adjustment of the bracket arm, in accordance with the specific anatomical geometry of a particular patient. The horizontal leg 48 of the angle bracket 40 may also be configured with a slight toe-in angle, as viewed in FIG. 3, such that the bracket post 50 and the bracket arm 58 will be oriented in a substantially vertical orientation, in response to pressure applied by the patient.

A variety of modifications and improvements to the anterior pelvic support device shown and described herein will be apparent to those skilled in the art. Accordingly, no limitation on the invention is intended by way of the foregoing description and accompanying drawings, except as set forth in the appended claims.

What is claimed is:

1. An anterior pelvic support device for supporting a surgery patient in a lateral decubitis position on a operating table, said support device comprising:

an upstanding bracket post;

means for mounting said bracket post onto the operating table to position said bracket post proximate to the anterior pelvic region of the patient; and a double-ended bracket arm and means for adjustable mounting of said bracket arm onto said bracket post, said bracket arm defining a pair of anterior support members disposed generally at opposite ends thereof in positions for respectively engaging and supporting the symphysis pubis and the lower side anterior superior iliac spine of the patient.

2. The anterior pelvic support device of claim 1 wherein said support members are padded.

3. The anterior pelvic support device of claim 1 wherein said adjustable mounting means comprises means for vertically adjusting said bracket arm relative to said bracket post.

4. The anterior pelvic support device of claim 1 wherein said adjustable mounting means comprises means for rotationally adjusting said bracket arm relative to said bracket post.

5. The anterior pelvic support device of claim 1 wherein the operating table has a side rail extending along one side thereof, said means for mounting said bracket post onto the operating table including means for releasibly attaching said bracket post to said side rail.

6. The anterior pelvic support device of claim 5 wherein said releasible attaching means comprises a generally L-shaped angle bracket, first clamp means for releasibly and adjustably clamping said bracket post onto said angle bracket, and second clamp means for releasibly and adjustably clamping said angle bracket to the bed side rail.

7. The anterior pelvic support device of claim 1 wherein said bracket arm includes a central portion connected between and offset relative to said support members, said support members being substantially coplanar to each other, said central portion being adjustably connected by said adjustable mounting means to said bracket post.

8. The anterior pelvic support device of claim 7 wherein said support members are carried by said central portion within a plane spaced from said bracket post in a direction toward the patient.

9. The anterior pelvic support device of claim 8 wherein said bracket post has a vertically elongated slot formed therein, said central portion including a mounting bolt extending therefrom in a direction away from said support members for reception through said slot, and a thumbscrew nut received onto said mounting bolt for releasibly clamping said bracket arm onto said bracket post in a selected position of vertical adjustment relative to the bracket post and rotational adjustment relative to an axis defined by said mounting bolt.

10. The anterior pelvic support device of claim 9 further including means for limiting rotational adjustment of said bracket arm relative to said bracket post.

11. The anterior pelvic support device of claim 10 wherein said limit means comprises at least one stop pin on said bracket arm and engageable with said bracket post.

12. The anterior pelvic support device of claim 11 wherein said limit means comprises a pair of stop pins on said bracket arm and engageable with said bracket post in a selected one of at least two different orientations of said bracket arm relative to said bracket post.

13. A support device for supporting a surgery patient in a predetermined position on an operating table, said support device comprising:

an upstanding bracket post;

means for mounting said bracket post onto the operating table to position said bracket post proximate to the patient;

a bracket arm having a central portion connected between and offset with respect to a pair of patient support members disposed in spaced-apart relation at opposite ends of said bracket arm; and means for adjustably and releasibly connecting said central portion of said bracket arm to said bracket post in a selected position of vertical and rotational adjustment relative to said bracket post so that said support members contact and support the patient at a pair of spaced-apart positions.

14. The support device of claim 13 wherein said support members are padded.

15. The support device of claim 13 wherein the operating table has a side rail extending along one side thereof, said means for mounting said bracket post onto the operating table including means for releasibly attaching said bracket post to said side rail.

16. The support device of claim 15 wherein said releasible attaching means comprises a generally L-shaped angle bracket, first clamp means for releasibly and adjustably clamping said bracket post onto said angle bracket, and second clamp means for releasibly and adjustably clamping said angle bracket to the bed side rail.

17. The support device of claim 13 wherein said support members are substantially coplanar and are disposed within a plane spaced from said bracket post in a direction toward the patient.

18. The support device of claim 17 wherein said bracket post has a vertically elongated slot formed therein, and wherein said adjustable connecting means comprises a mounting bolt extending from said central portion in a direction away from said support members for reception through said slot, and a thumbscrew nut received onto said mounting bolt for releasibly clamping said bracket arm onto said bracket post in a selected position of vertical adjustment relative to the bracket post and rotational adjustment relative to an axis defined by said mounting bolt.

19. A patient support system for supporting a surgery patient in a lateral decubitis position on an operating table, comprising:

an upstanding bracket post;

means for mounting said bracket post onto the operating table to position said bracket post proximate to the anterior pelvic region of the patient; and a double-ended bracket arm carried by said bracket post, said bracket arm defining a pair of anterior support members disposed generally at opposite ends thereof in positions for respectively engaging and supporting the symphysis pubis, and the lower side anterior superior iliac spine of the patient; and at least one posterior support element for engaging and supporting the patient at a posterior location disposed generally opposite to said anterior support members.

20. The support system of claim 19 further including an anterior chest support member and a posterior chest support member for engaging the patient respectively at anterior and posterior portions of the patient's chest.

* * * * *